US008020271B2

(12) United States Patent
Baum et al.

(10) Patent No.: US 8,020,271 B2
(45) Date of Patent: Sep. 20, 2011

(54) SELF-RAISING FORM CONTROL SYSTEM AND METHOD

(75) Inventors: Norton Baum, Inverness, IL (US); Norman John Dziedzic, Jr., Park Ridge, IL (US)

(73) Assignee: Norton Baum, Inverness, IL (US)

( * ) Notice: Subject to any disclaimer, the term of this patent is extended or adjusted under 35 U.S.C. 154(b) by 57 days.

(21) Appl. No.: 12/171,694

(22) Filed: Jul. 11, 2008

(65) Prior Publication Data

US 2009/0041879 A1 Feb. 12, 2009

Related U.S. Application Data

(60) Provisional application No. 60/959,093, filed on Jul. 11, 2007.

(51) Int. Cl.
*B23Q 17/00* (2006.01)

(52) U.S. Cl. ..... 29/407.05; 29/407.01; 29/897.3; 29/706; 29/707; 29/709; 249/20; 249/21; 249/22

(58) Field of Classification Search ..... 29/407.01, 29/407.05, 705–707, 709, 714, 897.3; 249/20–22; 425/63–65

See application file for complete search history.

(56) References Cited

U.S. PATENT DOCUMENTS

| | | | | |
|---|---|---|---|---|
| 2,636,274 | A | 4/1953 | Marsh | |
| 3,165,835 | A | 1/1965 | Duncan | |
| 3,775,929 | A | 12/1973 | Roodvoets et al. | |
| 3,779,678 | A * | 12/1973 | Scheller | 425/65 |
| 3,824,666 | A | 7/1974 | Roodvoets et al. | |
| 3,973,885 | A * | 8/1976 | Schmidt | 425/65 |
| 4,040,774 | A * | 8/1977 | Scheller | 425/65 |
| 4,053,238 | A | 10/1977 | George et al. | |
| 4,674,870 | A | 6/1987 | Cain et al. | |
| 4,732,471 | A | 3/1988 | Cain et al. | |
| 4,889,425 | A | 12/1989 | Edwards et al. | |
| 4,889,997 | A | 12/1989 | Tomiolo | |
| 4,917,346 | A * | 4/1990 | Mathis | 249/20 |
| 5,198,235 | A * | 3/1993 | Reichstein et al. | 425/62 |
| 5,492,437 | A * | 2/1996 | Ortiz | 405/230 |
| 6,014,220 | A | 1/2000 | Kimura | |
| 6,253,160 | B1 * | 6/2001 | Hanseder | 702/95 |
| 6,370,837 | B1 | 4/2002 | McMahon et al. | |
| 6,483,026 | B1 | 11/2002 | Snider, Jr. et al. | |
| 6,557,817 | B2 * | 5/2003 | Waldschmitt et al. | 249/20 |
| 6,601,309 | B1 | 8/2003 | Hedstrom | |
| 6,874,739 | B1 | 4/2004 | Gregory | |
| 7,137,207 | B2 | 11/2006 | Armstrong et al. | |
| 2005/0086901 | A1 | 4/2005 | Chisholm | |

FOREIGN PATENT DOCUMENTS

| | | |
|---|---|---|
| CH | 666513 | 7/1988 |
| JP | 3180669 | 8/1991 |

* cited by examiner

*Primary Examiner* — David P Bryant
*Assistant Examiner* — Bayan Salone
(74) *Attorney, Agent, or Firm* — Erickson Law Group, PC

(57) ABSTRACT

A self-raising form control system and method is provided that that may be used to form elevator shafts and other vertical building structures. The apparatus includes one or more form elements for defining an area to receive a formable material, such as concrete. Each element is attached to the form structure. A lift apparatus is provided for lifting the form elements. The lift apparatus comprises a measurement device for measuring the position of said lift apparatus relative to a fixed point. The lift apparatus is connected to the form structure. A control unit is provided for controlling the lift apparatus. The control unit is signal connected to the measurement device and is signal connected to the lift apparatus.

20 Claims, 10 Drawing Sheets

SECTION (A–A)

SECTION (A–A)

SECTION (A–A)

SELF-RAISING FORM CONTROL SYSTEM AND METHOD

This application claims the benefit of U.S. provisional patent application Ser. No. 60/959,093 filed on Jul. 11, 2007.

FIELD OF THE INVENTION

The invention relates to systems for lifting a concrete forming structure or apparatus.

BACKGROUND

Hydraulically lifted concrete form systems for elevator cores are presently known and used on building construction sites. In leveling these hydraulically lifted concrete forms from floor to floor, several systems are presently used, and they each have significant drawbacks.

The first known raising system utilizes water levels. The problems with water levels are that they must be maintained and serviced prior to every lift to be sure they are operational. The accuracy of the lift is determined by the operator of the system. The accuracy of how even the form is lifted is dependent on how quickly the water levels respond in the tubes and how quickly the operator responds to variances. Often times the operator will ignore or not be aware of variances that can be critical to the loading of major form components creating an unsafe condition.

The water lines used in a water leveling system can often become kinked and/or clogged causing the readings to be incorrect. During winter conditions, precautions have to be taken to be sure that the water or other liquid in the lines does not freeze. In summer conditions, the water or other liquid in the lines can evaporate, requiring the operator to top off the liquid prior to starting. Because of the length of the water lines and the routing that often times must be taken, the lines are prone to damage. All these factors contribute to inaccuracy in the lifting process. Frequently the water levels are ignored, and the concrete form is lifted with no leveling assistance.

A second type of system used to coordinate lifting the system involves having men located at each of the critical lifting points to physically measure the progress of the lift from the previous pour as it progresses. The progress is often shouted out to the operator or communicated via radio. The operator analyzes what each of the measurements mean and turns the power units on or off accordingly. The system is very labor intensive and inaccurate requiring many men to measure at once and is only as accurate as the men doing the physical measurement and the ability of the operator to analyze the information and respond quickly to it.

A third method depends on the operator's ability to sense that the concrete form is rising. In this method, the operator uses reference structures that are close by to coordinate the rise of the system. This method is the most inaccurate since no actual measuring devices are used.

A fourth method depends on the repeatability of mechanical pump valves or sensors. This method operates on the theory that if all cylinders are pumped an equal volume, they will all ascend equally. This is often not true because the equipment used cannot guarantee repeatability. For instance, there may be leakage in the system or there may be variances in the construction of the items employed in the lift. The number of hydraulic cylinders coordinated at once is limited.

Monitoring the system in order to achieve the desired lift height on all four systems depends on a physical measurement by the operator or a helper of the operator.

The present inventors recognize a need for a form control and monitoring system that coordinates all hydraulic cylinders quickly, safely and precisely.

SUMMARY OF THE INVENTION

The invention provides a form control and monitoring system that coordinates the raising of form elements by lift apparatus so that the form elements are lifted in a closely controlled, automatic manner. The lift apparatus includes plural lifting devices wherein the extent of lifting at each device is closely controlled with respect to the other lifting devices. This close control can be used to ensure a precise, even lifting of the entire lift apparatus. The control and monitoring system of the invention particularly enhances hydraulically lifted concrete form systems such as used for elevator cores.

The invention includes one or more form elements for defining an area to receive a formable material, such as concrete. According to one embodiment, each element is attached to the form structure. A lift apparatus is provided for lifting the form elements. The lift apparatus comprises a measurement device for measuring the position of the lift apparatus relative to a fixed point. The lift apparatus is connected to the form structure. A control unit is provided for controlling the lift apparatus. The control unit is signal connected to the measurement device and is signal connected to the lift apparatus.

In one embodiment, the lift apparatus comprises a plurality of jack assemblies connected to the form structure. The jack assemblies are connectable to a formed object, such as a previously formed concrete structure, or a base. Each jack assembly comprises an actuator, such as for example a hydraulic cylinder for raising the form elements along with the form structure.

In another embodiment, the measurement device comprises a plurality of sensors. Each sensor is connected to each jack assembly for measuring a distance that the actuator moves the form structure.

In another embodiment, the control unit comprises deviation calculating instructions for calculating a deviation defined by a difference between a position of each jack as reported by the corresponding sensor. The control until continuously computes the deviation while the control unit is in a lifting mode. The control unit comprises deviation comparison instructions for comparing the deviation to a predefined deviation tolerance range. The control unit comprises pausing instructions for stopping a respective one or more of the jacks when the sensor corresponding to the jacks provides a position value that is outside of the deviation tolerance range.

In another embodiment, the control unit comprises pausing instructions for pausing one jack while the sensor corresponding to the jack reports a position value that is outside of a deviation tolerance range and above the position values of the non-paused jacks. Also the control unit may comprise pausing instructions for pausing all other jacks while the sensor corresponding the non-paused jack reports a position value that is outside of a deviation tolerance range and below the position values of the paused jacks.

The control unit may comprise completion detecting instructions for signaling one or more of the jacks to stop when the jack has reached the pre-defined or a user defined lift distance or final lift height.

After the lift is complete the form elements or panels can be anchored to the previously formed object, for example concrete. The jacks then may be disconnected from the formed object and retracted back to their starting position.

Numerous other advantages and features of the present invention will become readily apparent from the following detailed description of the invention and the embodiments thereof, and from the accompanying drawings.

DETAILED DESCRIPTION OF THE PREFERRED EMBODIMENTS

Figure 1:
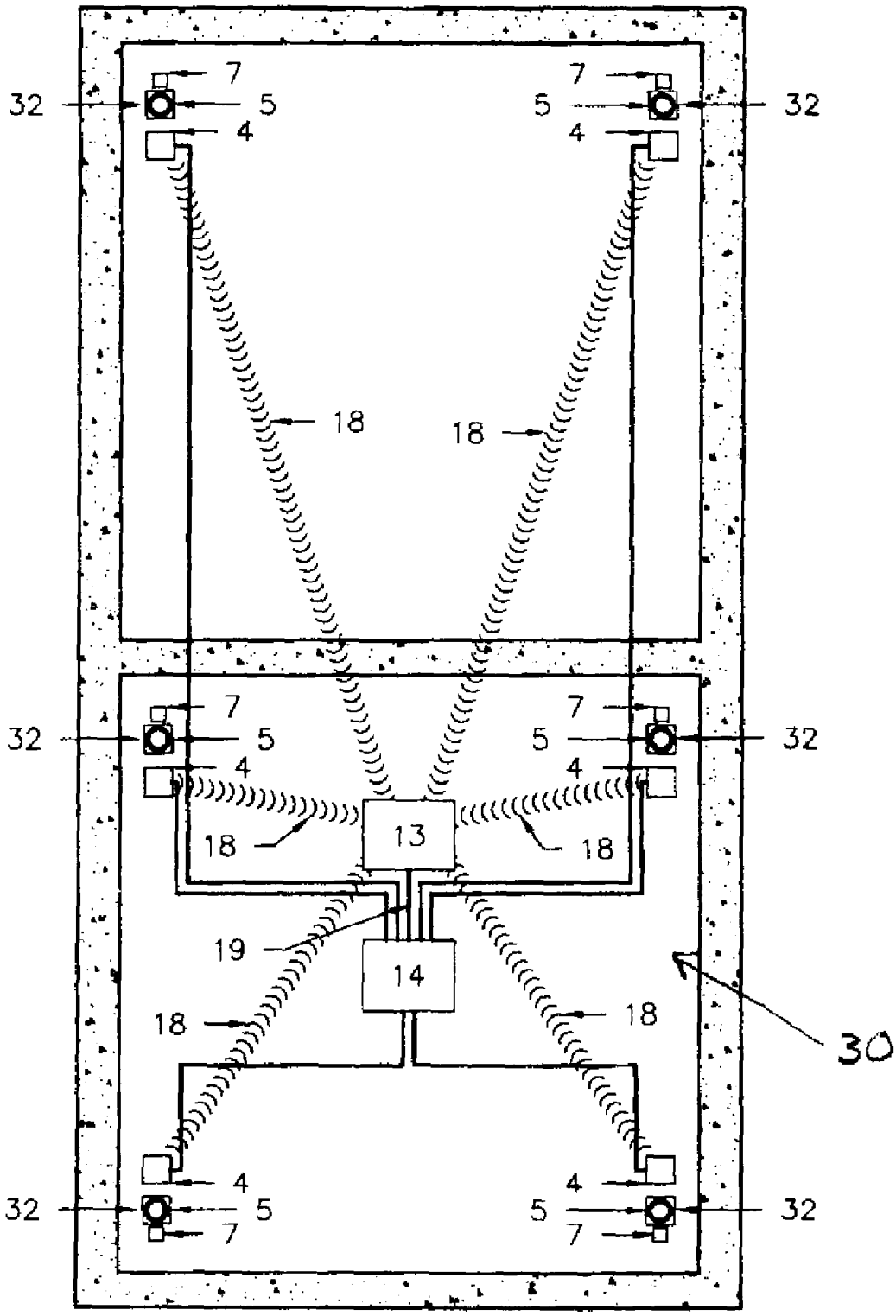
FIG. 1 is an overview drawing (with many components removed) of an exemplary construction site depicting the wireless signals and a representative plan view of the present invention.
Figure 1A:
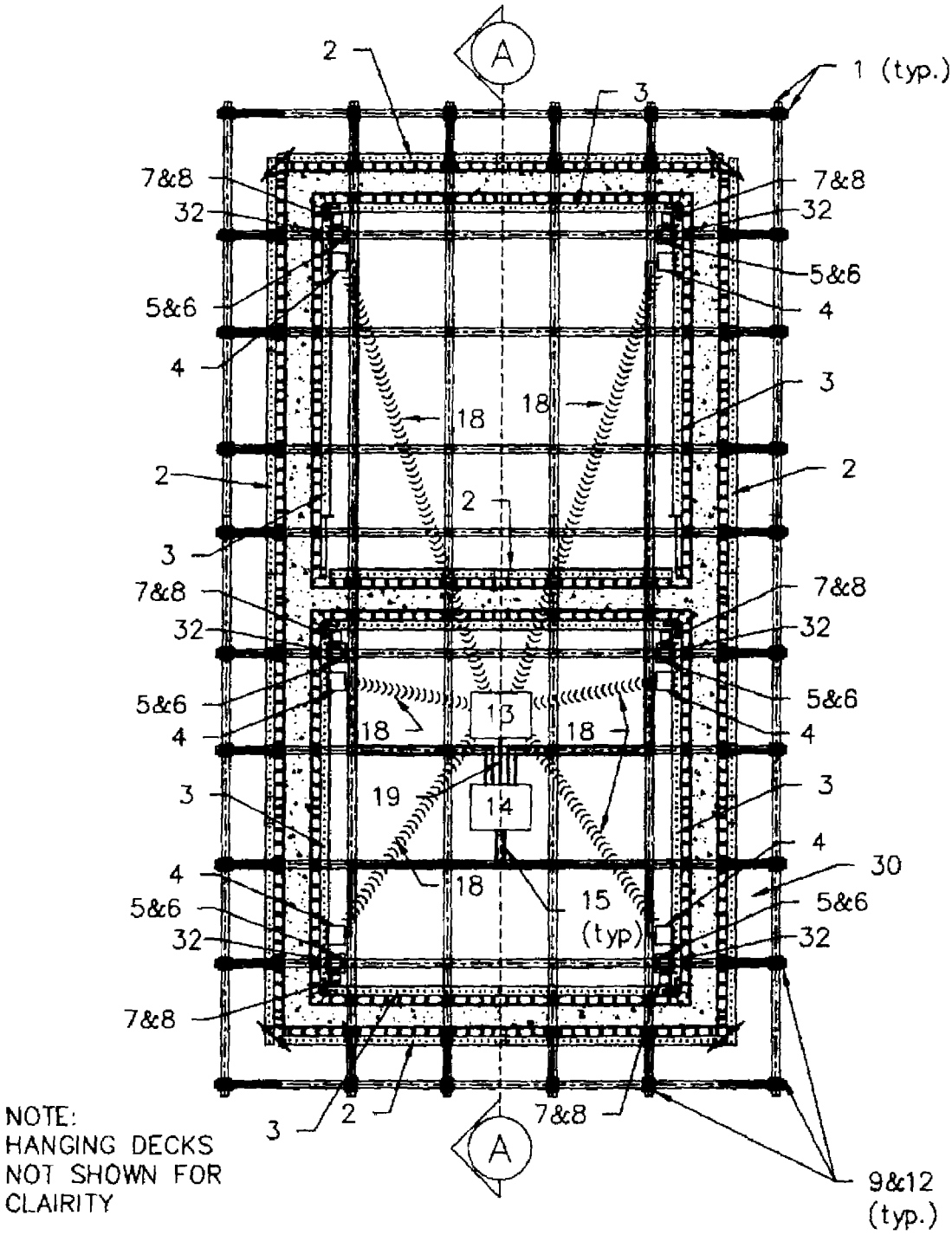
FIG. 1A is a detailed view of an exemplary construction site depicting a plan view of the present invention.
Figure 2:
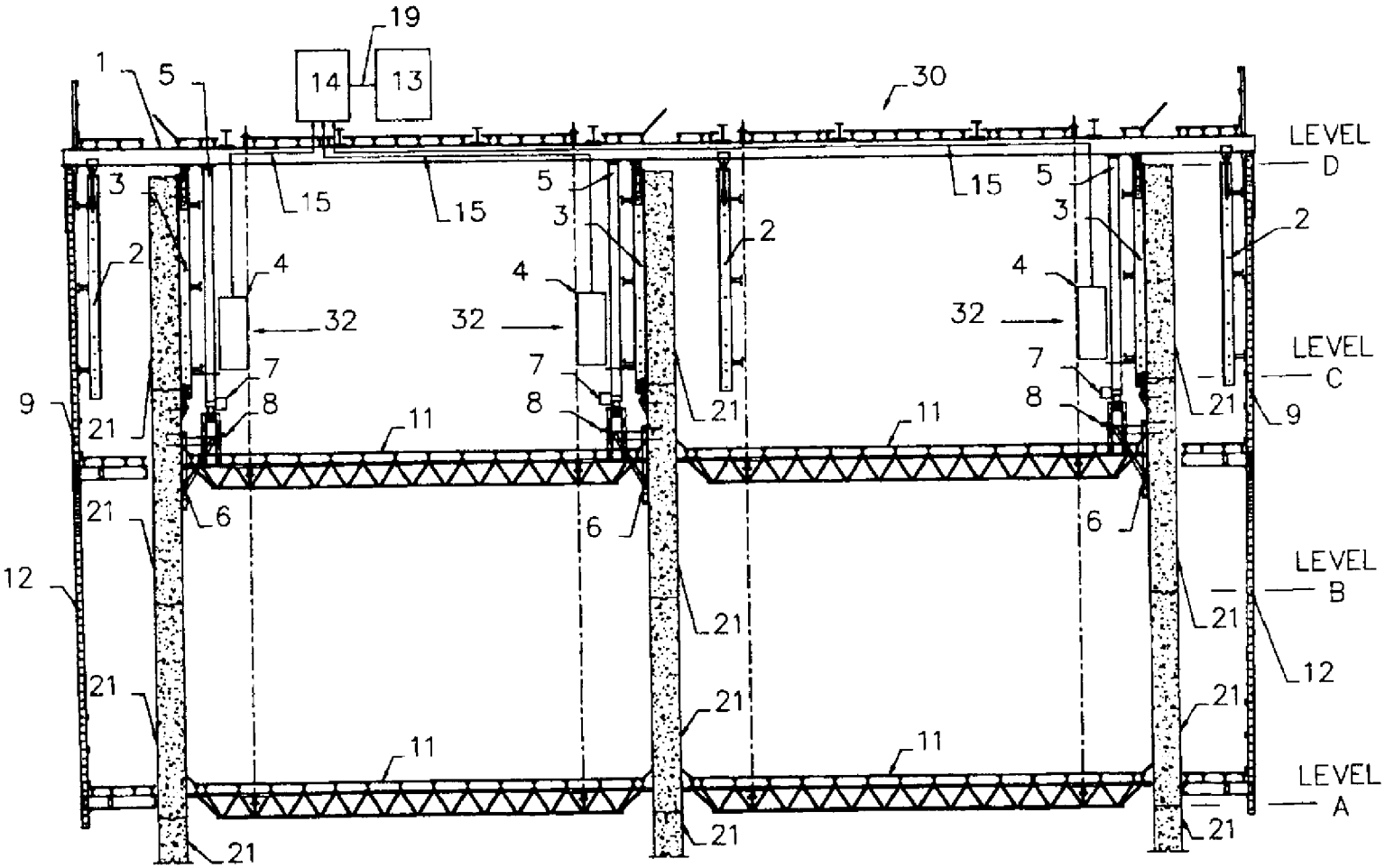
FIG. 2 is a side elevational view of the form lift of the present invention taken along the line 1A-1A in FIG. 1A showing the form lift in an initial position.

Referring to FIGS. 1, 1A and 2, a self-raising form control system 30 of the present invention is illustrated in an initial set up position. Referring specifically to FIG. 2, it can be seen that the concrete for levels A through C have been poured and formed and that the form control system 30 has been put in place prior to extending the form for the next level (Level D). Deck levels 11 have been put in place on each level between the formed concrete. Outside hanging scaffolding 9, 12 has also been put in place to give personnel access to the concrete form assembly. The form control system 30, in this embodiment, includes a central control panel 13, a power control panel 14, a grid support beam 1 and a number of jack assemblies 32. In this embodiment, the form control system 30 includes six jack assemblies 32, as shown in FIG. 1A, which are attached to the grid support beam 1.

As shown in FIG. 2, the central control panel 13 and the power control panel 14 are connected to the grid support beam 1. A number of fixed concrete form panels 3 and movable or rolling concrete form panels 2 are also connected to the grid support beam 1. In the figures depicting this embodiment, the central control panel 13 and the power control panel 14 are shown as separate units. However, it should be understood that the central control panel 13 and the power control panel 14 can be built integrated with one another. The control panel 13 and the power control panel 14 maybe integrated into a control unit.

In one embodiment, the control unit may be a computer and the control unit may comprise one or more electronic processor chips, programmable logic controllers, logic processors, memory circuits, RAMs, ROMs, electronic chips, and or microprocessors. In one embodiment, the functions and or operations carried out by the control unit can be in the form of machine readable instructions. In one embodiment, the machine readable instructions may, for example, comprise one or more gates of a circuit, instructions hardcoded into a circuit, or programmable instructions, as for example software code, executed by a processor or circuit capable of reading those instructions.

Figure 3:
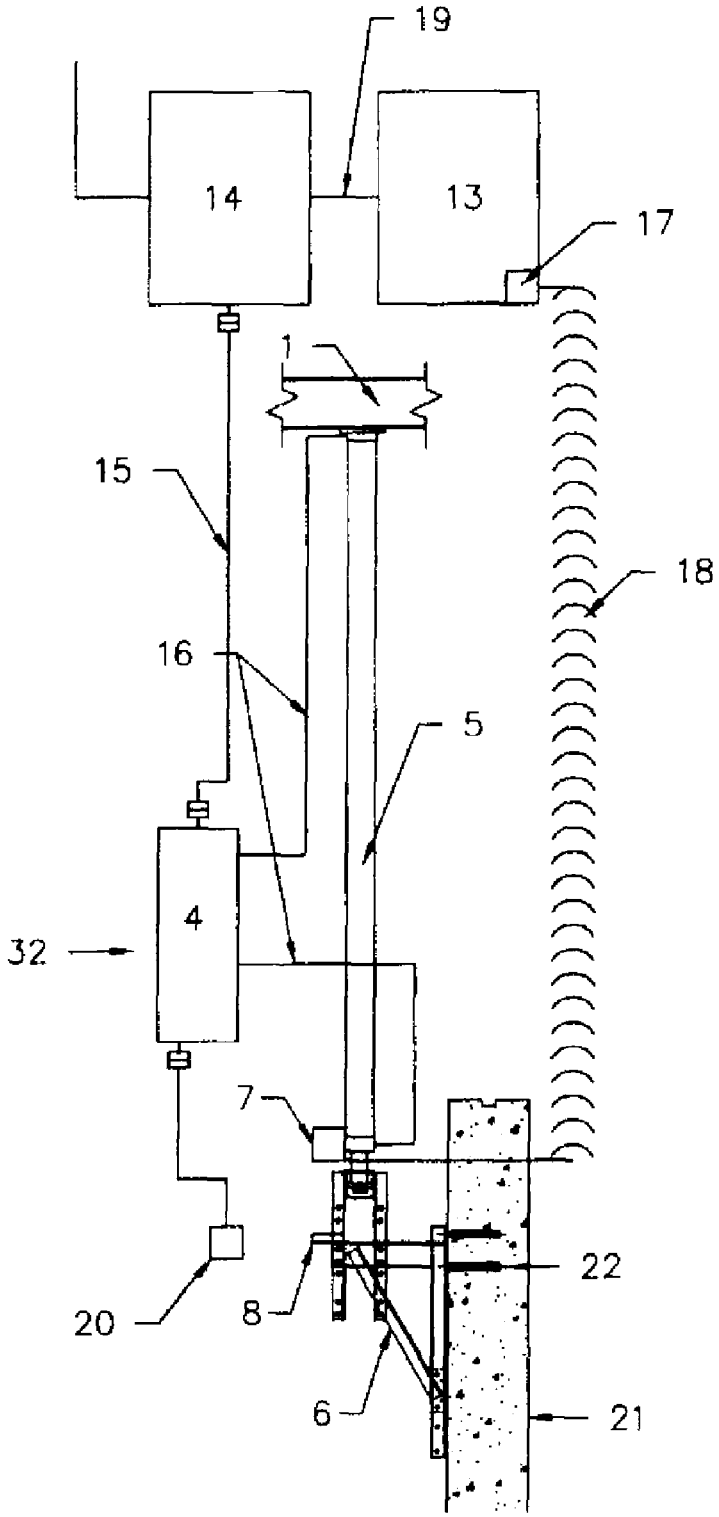
FIG. 3 is a detail view of a jack assembly of the present invention, showing its components and other components of the system.

Also, referring to FIG. 3, the central control panel 13, in one embodiment, includes a transceiver 17 and a power line 19. The power line 19 is connected to the power control panel 14.

In this embodiment, referring specifically to FIG. 3, each jack assembly 32 includes a jack support bracket 6, a target 8, a position sensor 7, an actuator 5, a lifting power unit 4, a pendant switch 20 and electric and hydraulic lines 15, 16. The actuator 5 may comprise, for example, a hydraulic cylinder, a pneumatic cylinder, or a servo motor. To put the form control system 30 in place, each jack assembly 32 is connected to the concrete wall 21 on the level previously formed by using concrete inserts 22 to attach the jack support brackets 6 for each jack assembly 32 to the concrete wall 21. The actuators 5 of each jack assembly 32 are connected to and support the grid support beam 1. In the initial set up position depicted in FIG. 2, the actuators 5 of each jack assembly 32 are all at the same starting height.

Figure 4A:
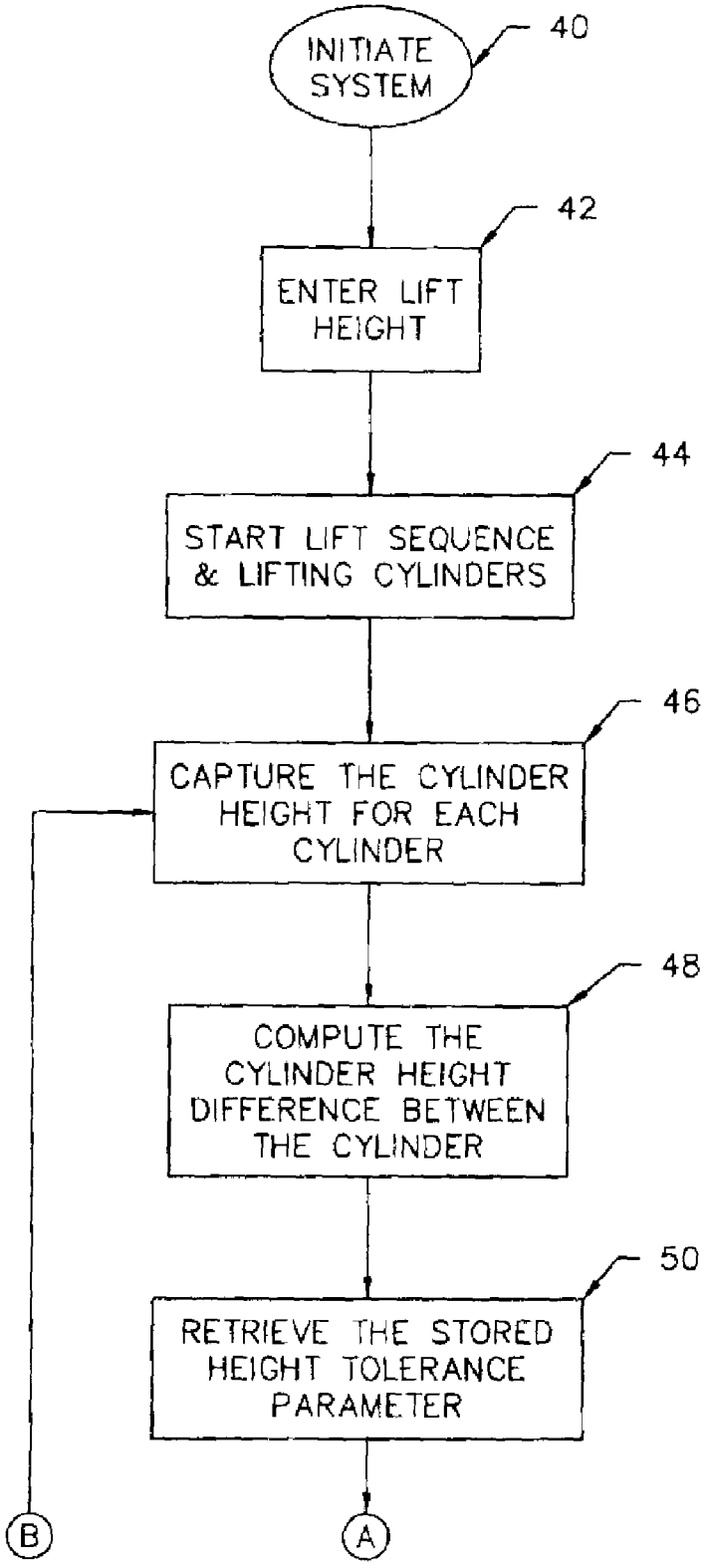
FIGS. 4A-4B are flow diagrams illustrating the process employed by a control panel during the lift of the form in an embodiment of the invention.
Figure 4B:
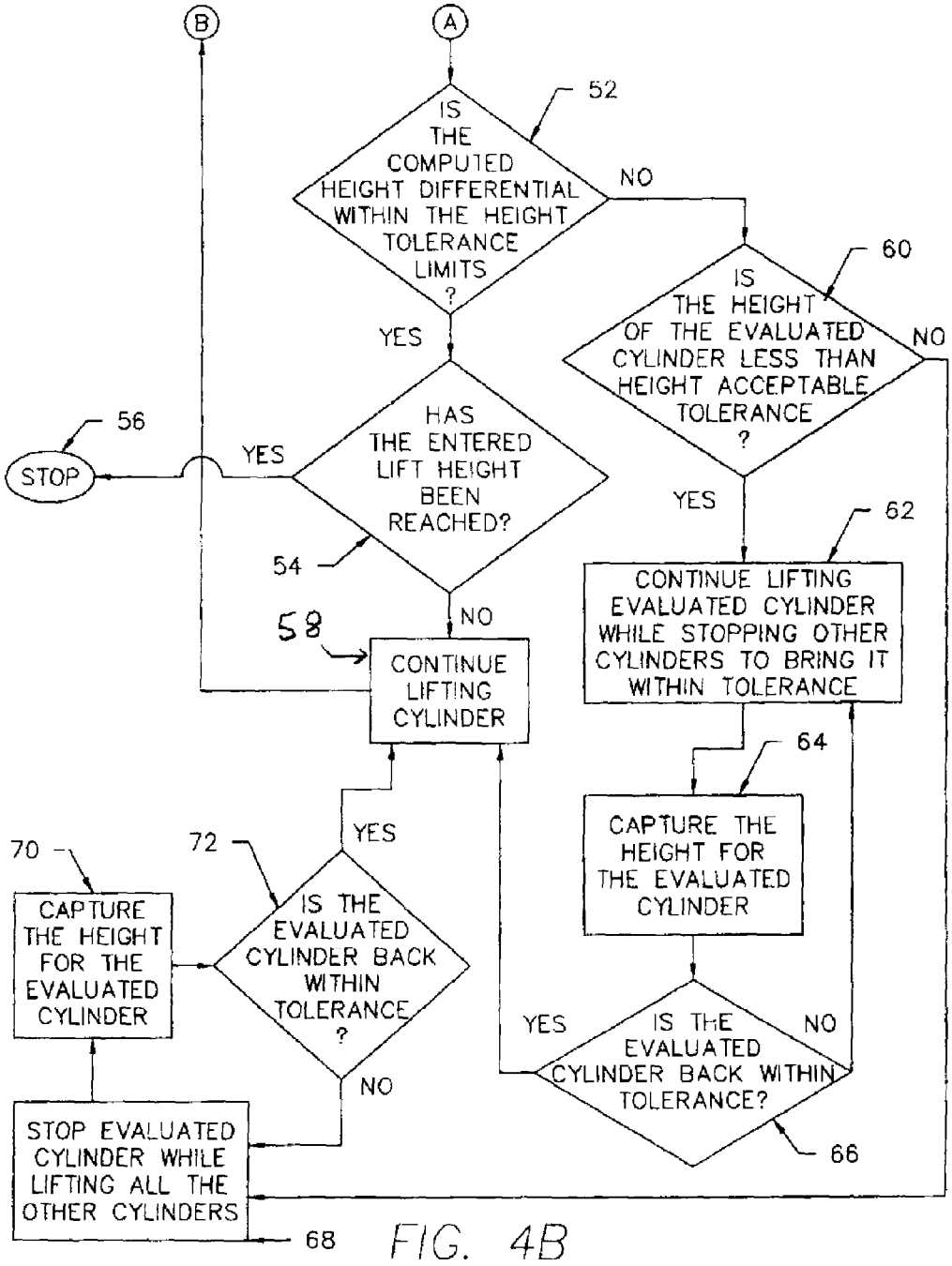

With the system 30 in the initial set up position, the system 30 is ready for operation. The process as described below and shown in FIGS. 4A and 4B may be carried out by the control unit in communication with the component parts, such as the jack assemblies 32, and with optional input from a user. At the start of the process, the system operator confirms that the actuators 5 are in fact all at the same level. If they are not, the operator manually adjusts the actuators 5 so they are at the same level.

Referring now to FIG. 4, the system operator at step 40 initiates the system. Then at step 42, the operator enters the lift height he wishes to raise the grid support beam 1, and this parameter is stored as a lift distance value. In an alternative embodiment, the lift distance value may be pre-programmed. The lift height or distance is the absolute distance the actuators 5 have to travel in this phase of the construction. After the lift height is entered, the operator starts the lift sequence and the actuators 5 begin to lift the grid support beam 1 as indicated at step 44. In one embodiment of the invention, the operator does this by pressing an "Automatic" and "Start" button on the central control panel 13. As the actuators 5 move upward, the position sensor 7 of each jack assembly 32 sends a signal downward towards the corresponding target 8 on the jack assembly 32. The jack assembly 32 captures the distance traveled by the signal between the position sensor 7 and the target 8 and uses this to determine the distance that the actuator 5 has moved or the distance the actuator 5 has moved the concrete form panels, which may be represented as a position value. The distance traveled by each actuator 5 is continually captured and transmitted from the position sensor of the jack assembly 32 to the transceiver 17 of the central control panel 13, as indicated at step 46 and by the signal lines 18 (FIGS. 1, 1A and 3). In one embodiment, the distance the actuator 5 has traveled is communicated from the jack assembly 32 to the transceiver 17 by a PHOENIX BLUETOOTH transceiver located inside the lifting power unit 4. In one embodiment, the position sensor 7 may be a laser positioning sensor that sends a laser signal toward a laser target 8 to determine the distance traveled by each actuator 5.

As indicated at step 48, as the central control panel 13 receives these continuous updates on the travel distance or position value of each actuator 5, the central control panel 13 continuously computes the height difference between the actuators 5. The process, as indicated at step 50, is also retrieving a pre-defined stored height tolerance parameter or deviation tolerance range. The process executed by the central control panel 13 then, at step 52, compares the computed height differential between the actuators 5 to the retrieved tolerance parameter or deviation tolerance range. If all of the actuators 5 are within the height tolerance parameter, the process proceeds to step 54 where it determines if the actuators 5 have reached the absolute height entered by the operator at the start of the lifting operation. If the actuators 5 have reached the absolute height, then the lifting process has been completed, and the process ends as indicated at step 56. If however at step 54 the absolute lift height has not vet been reached, then the process continues to step 58 where the system continues to lift the actuators 5, and the process returns back to step 46.

Referring again to step 52, if the process had determined that the height differential between the actuators 5 was not within the height tolerance parameter, then the process proceeds to determine if the height of the evaluated actuator 5 is less than the acceptable tolerance at step 60. If the height of the evaluated actuator 5 is less than the acceptable tolerance, then the height of the evaluated actuator 5 is too low with respect to the other actuators 5 being lifted and needs to be raised. The process then at step 62 stops the actuators 5 that are not out of tolerance, while it lifts the actuator 5 that is out of tolerance. While the process does this, it is also capturing the height of the lower actuator 5 that is being lifted at step 64, and at step 66, it is evaluating whether the actuator 5 being lifted is back within tolerance. If it is, then, as indicated at step 58, the process proceeds to lift all of the actuators 5 again. If, however, the process determines at step 66, that the actuator 5 being lifted is still not within the tolerance, the process returns to step 62 and continues to lift the lower actuator 5. This process continues until the lower actuator 5 is brought within height differential tolerance with respect to the other actuators 5 so that it can continue to lift with the other actuators 5.

Referring again to step 60, if the process determines that the height of the evaluated actuator 5 is not less than the acceptable tolerance, then it must be greater than the acceptable tolerance because at step 52 it was determined that the height differential was outside of the acceptable tolerance either on the high or low side. As such, the height of the evaluated actuator 5 is too high with respect to the other actuators 5 being lifted, and the other actuators 5 need to be raised. The process proceeds to step 68 where the process stops the evaluated actuator 5 that is too high and out of tolerance, while it lifts the other actuators 5 to bring the height differential back within tolerance. While the process does this, it is also capturing the height of the higher actuator 5 with respect to the actuators 5 that are being lifted at step 70, and at step 72, it is evaluating whether the stopped actuator 5 is back within tolerance. If it is, then, as indicated at step 58, the process proceeds to lift all of the actuators 5 again. If, however, the process determines at step 72, that the stopped actuator 5 is still not within the tolerance, the process returns to step 68 and continues to lift the other actuators 5, while holding the actuator 5 that is too high. This process continues until the actuator 5 that is too high is brought within the height differential tolerance with respect to the other actuators 5 so that it can continue to lift with the other actuators 5.

Figure 7:
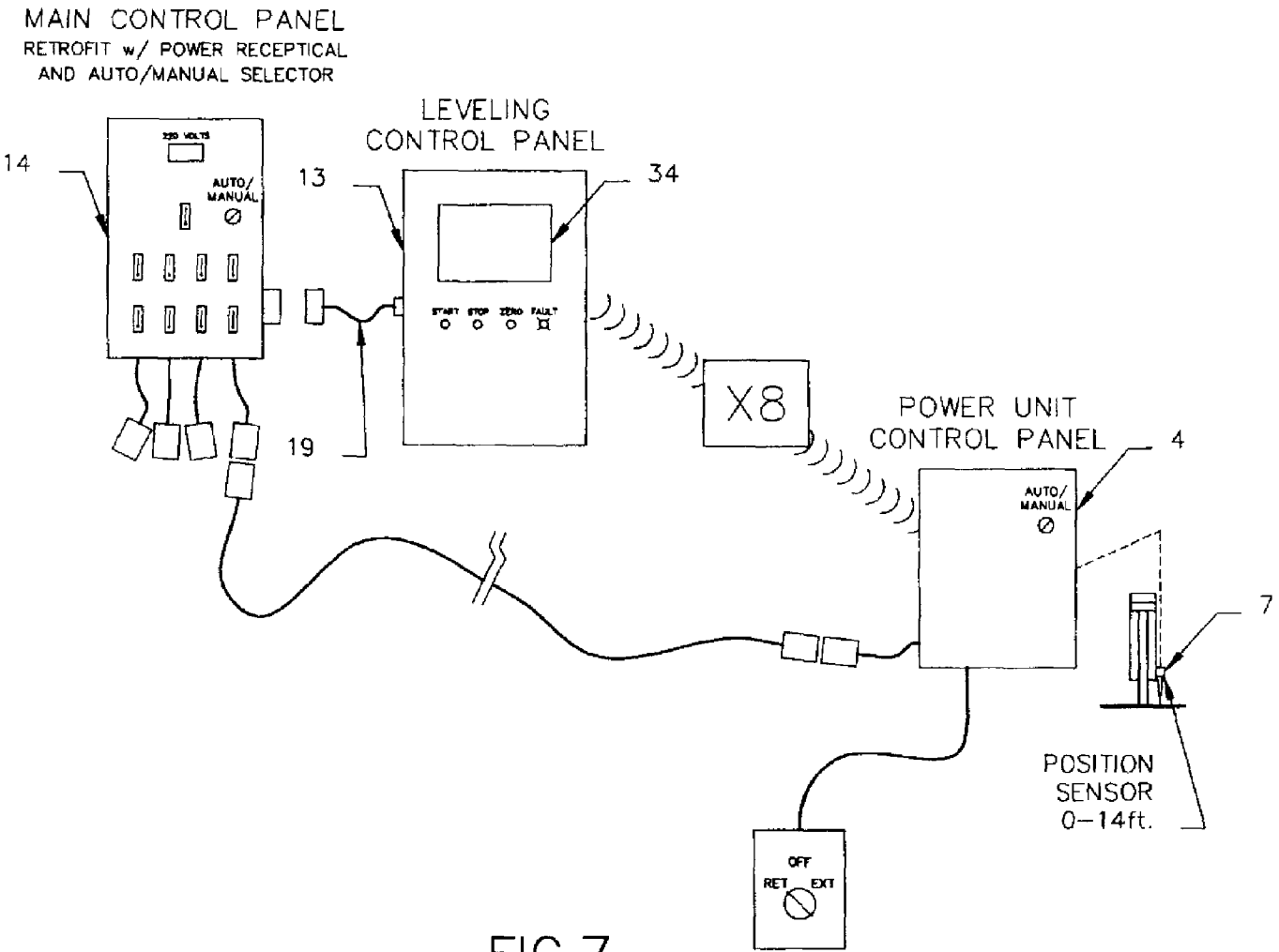
FIG. 7 is an exemplary central control panel, power panel and a lifting power unit arrangement.

In one embodiment, during the lift, a display monitor 34 (FIG. 7) in the central control panel 13 displays bar charts representing the progress of each actuator 5. The height that each actuator 5 has lifted is displayed next to it, as well as the number of times that it has been turned on and off during this lift. The elapsed time of the current lift and the total height of the current lift are also displayed. A logic processor monitors to see that communications are constantly kept with the position sensors 7. If communications are lost, a fault light is lit on the central control panel 13, and a message displayed on its monitor 34. If the operating voltage drops below a predefined minimum voltage, such as 208 volts, as monitored by a voltage transducer in the power control panel 14, the logic processor posts a warning message to the user, such as on the monitor, stating, for example, that the "Operating voltage has dropped below the minimum. Damage to the system may result from continued operation."

Figure 5:
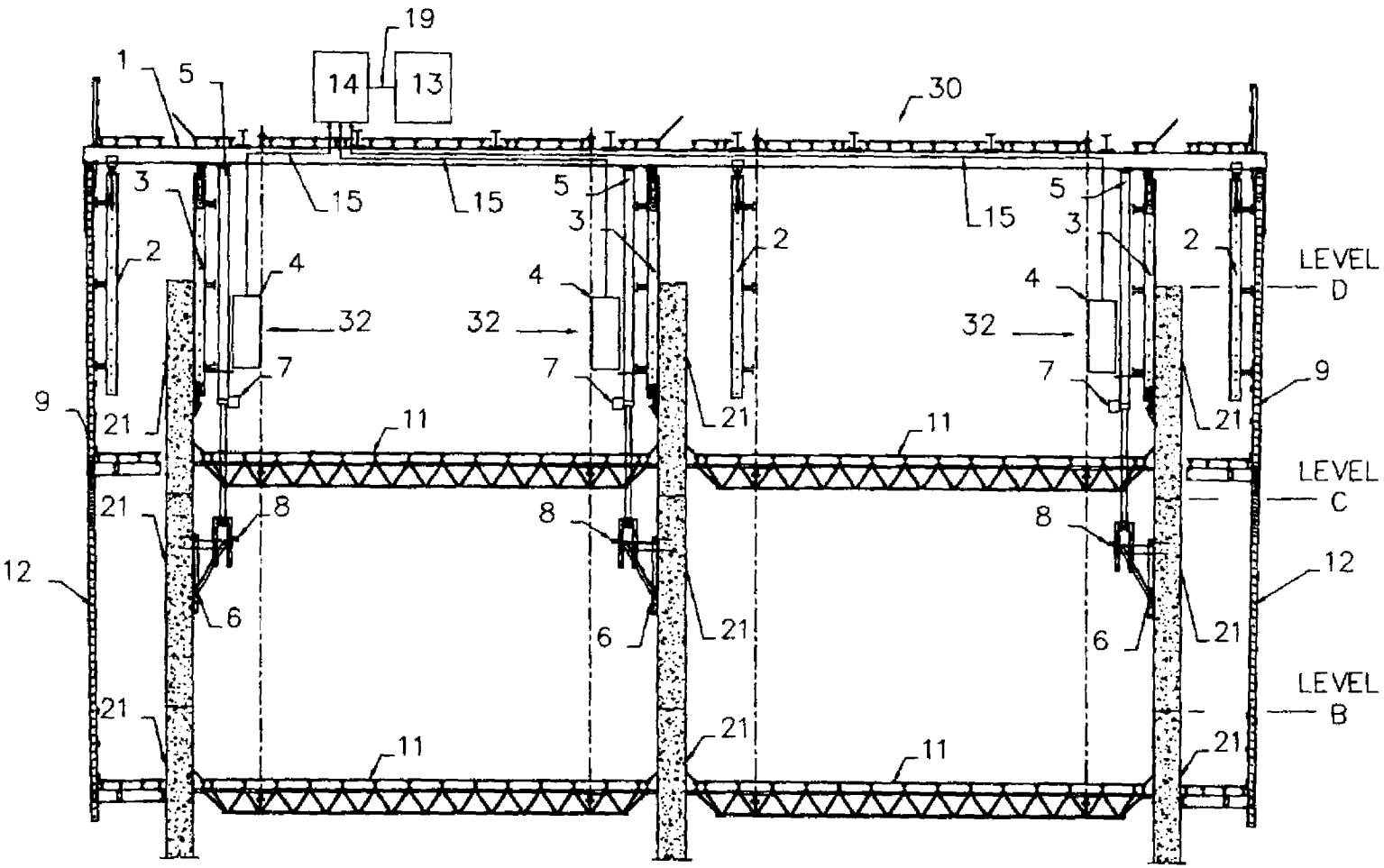
FIG. 5 is a side elevational view of the form lift of the present invention, similar to the view of FIG. 2, showing the form lift in an intermediate position.

Referring now to FIG. 5, the hydraulic lift is illustrated in an intermediate position. At this point, the logic processor in the central control panel 13 is in control of the lift in automated mode. It is evaluating each actuator 5, and raising them as described above to achieve an even lift to the pre-designated lift height.

Figure 6:
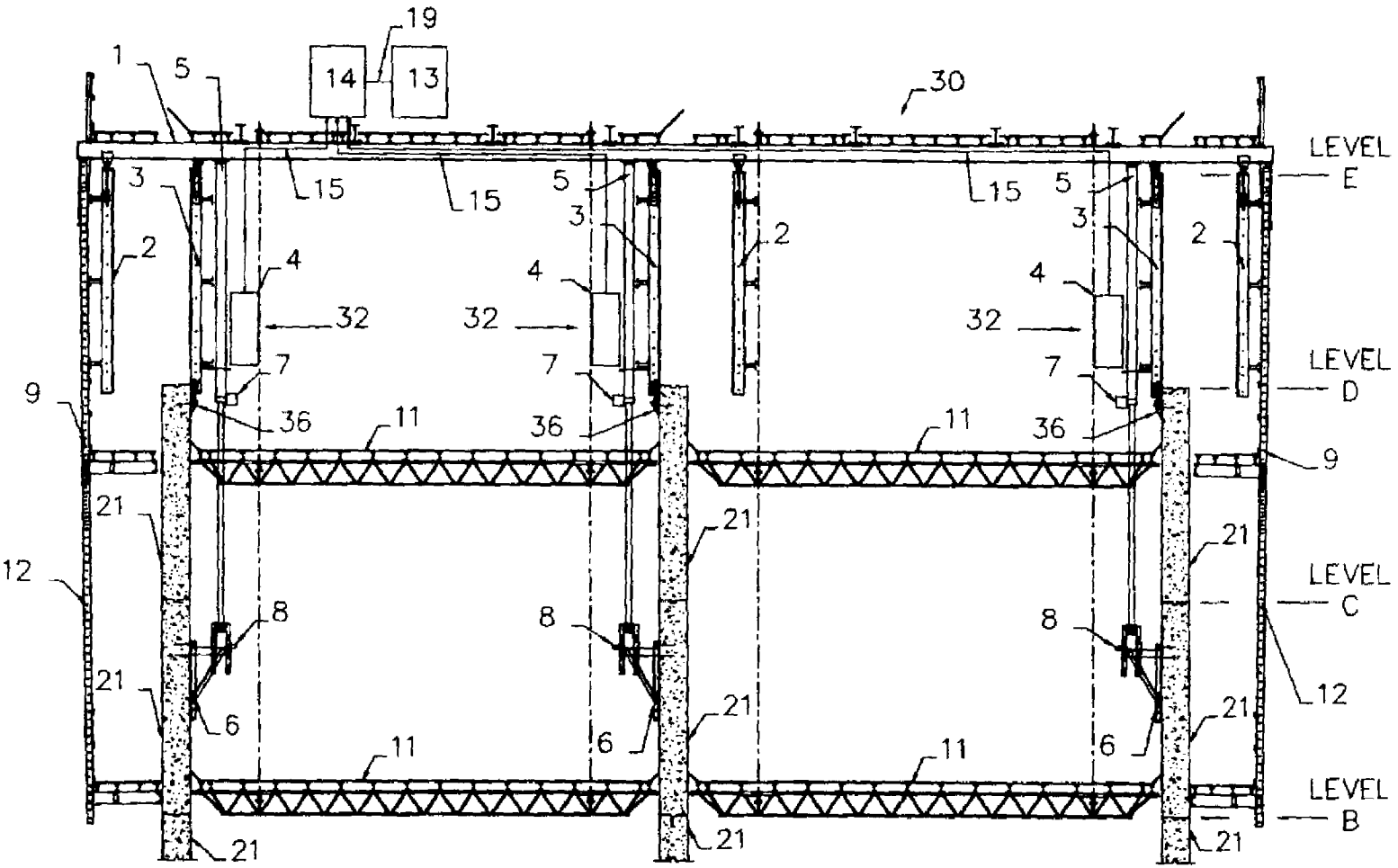
FIG. 6 is a side elevational view of the form lift of the present invention, similar to the view of FIG. 2, showing the form lift in a final lift position.

Referring now to FIG. 6, the hydraulic lift is illustrated in a final position. The final lift height that was entered at the start of the lift has been achieved. The system has shut down. Once the lift height has been achieved, the rolling concrete form panels 2 and the fixed concrete form panels 3 are re-anchored in the previous pour 21 using landing brackets 36 and are made ready for the next pour. At this point, all concrete form panels 2, 3 are completely supported on landing brackets 36, using concrete inserts 22 (shown in FIG. 3), in the previous pour. The actuators 5 that were used to raise the grid support beam 1 to the present level are unbolted from the concrete 21 at the jack support brackets 6. The actuators 5 are retracted upward toward the grid support beam 1 for the next lift position. In one embodiment, this is accomplished by first turning the main power switch on the power control panel 14 to off and turning the switch on the central control panel 13 to manual. The lifting power unit 4 for each jack assembly 32 is also set to the manual position, and the pendant switch 20 (shown in FIG. 3) for each jack assembly 32 is set to the off position. The main power switch on the power control panel 14 can then be turned on. This allows each lifting power unit 4 to lift or retract its actuator 5 using the pendant switch 20.

Figure 9:
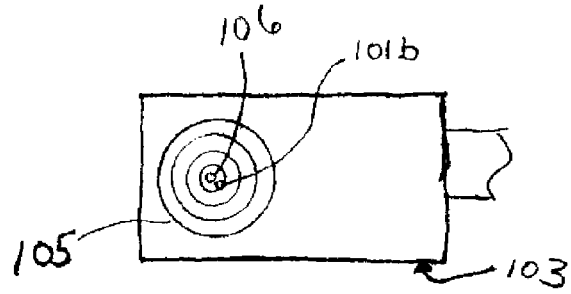
FIG. 9 is a bottom view of a vertical alignment target of the vertical alignment verification system.
Figure 8:
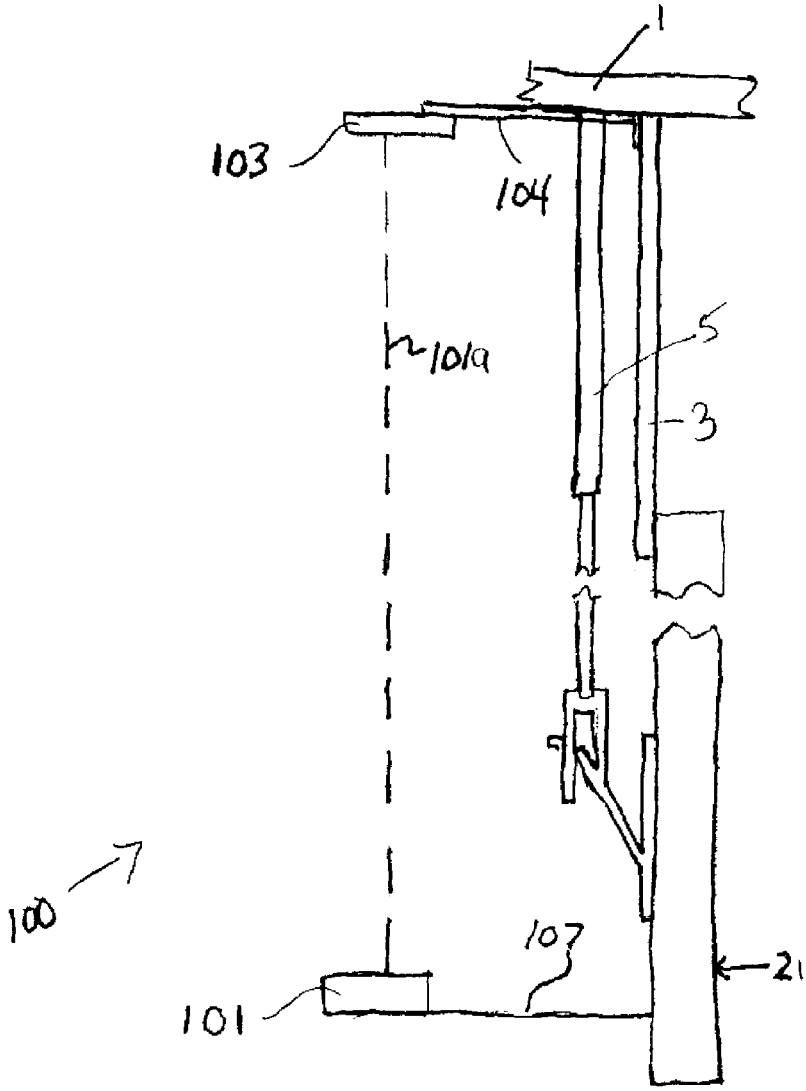
FIG. 8 is a side schematic view of a vertical alignment verification system with elements of the jack assembly removed for clarity.

FIG. 8 and FIG. 9 show a vertical alignment verification system 100 of the present invention. The system 100 comprises an alignment laser 101 and an alignment target plate 103. The target plate is preferably attached to an inside of a respective form panel 3, near the top thereof, by a bracket 104. In this way, the target is always pre-located at an exact position on the system 30. The alignment laser emitter 101 is attached to the concrete wall 21 or other reference structure. When activated, the alignment laser emitter 101 projects a vertically projected visible point laser beam 101*a* that effects a laser point 101*b* (FIG. 9) on the target plate 103. The laser emitter 101 is self-plumbing to ensure true verticality of the laser beam 101*a*. The target plate 103 contains a target 105 with a center 106. The target plate is transparent or translucent PLEXIGLAS or the like.

A user visually inspects the target plate from above to ensure that the laser point 101*b* generated by the alignment laser emitter 101 is centered on the center 106 of the target 105 to ensure the self-raising form control system 30 and the form panels 3 are in proper vertical alignment. The user may set the preferred proper vertical alignment to provide that the concrete walls 21 are formed perpendicular to the ground or perpendicular to some set horizontal reference. If a user determines that the laser is not centered on the target 106, the user will make manual adjustments to the self-raising form control system 30 to bring the system into proper vertical alignment. In another embodiment, the vertical alignment verification system may comprise a controller and a smart target that automatically checks for proper vertical alignment and makes corresponding adjustments or alerts a user that vertical alignment is not within range.

The vertical alignment verification system 100 may comprise an alignment laser emitter and an alignment target plate pair 101/103 at each actuator 5. However, having a laser emitter and an alignment target plate pair 101/103 on every jack may not be necessary to ensure proper vertical alignment. For a square arrangement of form panels, a minimum of three laser emitter and target plate pairs 101/103 is preferred to ensure proper vertical alignment for every square shaft created by the concrete walls 21.

The alignment laser emitter 101 may be located one level below the target level. For example, in FIG. 6, the laser emitter 101 may be located at level D when verifying vertical alignment of the self-raising form control system 30 from level D to level E. To provide greater accuracy, as available as the levels increase in elevation, the laser emitter 101 may be placed three, four, or more levels below the target level. For example, in FIG. 6, the laser may be located at level B or level A below the target level E.

Once the actuators 5 are retracted to the next lift position, the jack assemblies 32, through the jack support brackets 6, are bolted to the previously poured concrete 21 for each jack assembly 32. After all the concrete forms are poured and stripped, the system is ready to make the next lift. The concrete forms are lifted in this fashion until the total height of the structure has been reached.

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

The invention claimed is:

1. A controlled method of raising a form, comprising the steps of: providing a plurality of jacks supporting m-a form structure; providing a plurality of lift position sensors corresponding to the plurality of jacks; supporting said jacks on a wall by anchoring the jacks to the wall; lifting said form structure with said plurality of jacks anchored to said wall; monitoring a lift position of each said jack with the lift position sensor corresponding to each said jack; and pausing one or more jacks while one or more lift position sensors corresponding to said one or more jacks reports a position value that is outside of a deviation tolerance range.

2. The method according to claim 1, wherein the step of monitoring comprises the steps of:

transmitting a jack lift position value to a control unit;

computing a deviation by comparing said jack lift position value to the jack lift position values corresponding to other jacks;

comparing the deviation to said deviation tolerance range.

3. The method of claim 2, wherein the step of transmitting comprises the step of wirelessly transmitting the jack lift position value to the control unit.

4. The method according to claim 1, further comprising the step of stopping the jack when the sensor corresponding to said jack reports a position value equal to a predefined final lift height value.

5. The method according to claim 1, wherein the pausing step comprises the step of:

when a sensor corresponding to at least one of said jack reports a position value that is outside of said deviation tolerance range and below the position values of other jacks having corresponding sensors reporting position values that are inside of said deviation tolerance range, pausing said other jacks.

6. The method according to claim 1, wherein the pausing step comprises the step of:

when a sensor corresponding to at least one of said jacks reports a position value that is outside of said deviation tolerance range and above the position values of other jacks having corresponding sensors reporting position values that are inside of said deviation tolerance range, pausing said at least one of said jacks.

7. The method according to claim 1, further comprising the steps of:

providing a final lift height value before said lifting step;

stopping each said jack when the corresponding sensor reports a position value equal to said final lift height value;

anchoring a plurality of form panels to said wall, said form panels being attached to said form structure.

8. The method of claim 1, wherein the step of monitoring comprises the step of sending a signal from the lift position sensor that is attached to a movable component of said corresponding jack to a stationary target.

9. The method of claim 1, wherein the step of monitoring comprises the steps of:

sending an outbound signal from the lift position sensor that is attached to a movable component of said corresponding jack to a stationary target;

detecting with the lift position sensor a reflected signal;

measuring the time elapsed between the time the outbound signal was sent the time the reflected signal was detected.

10. The method of claim 1, wherein the step of monitoring comprises the step of sending a signal from the lift position sensor, which is attached to a movable component of said corresponding jack, along a longitudinal length of the jack to a stationary target.

11. The method of claim 1, wherein the step of monitoring comprises the step of sending a signal from the lift position sensor a stationary target.

12. The method of claim 1, wherein the step of anchoring the plurality of jacks to the wall comprises driving concrete inserts into the wall and supporting the jacks thereon.

13. The method of claim 1, comprising the step of displaying to a user on a display the lift position of each jack as reported by the corresponding lift position sensor.

14. The method of claim 1, comprising the step of, before lifting, checking the vertical alignment of the form structuring by receiving a vertical alignment position value from a vertical alignment sensor.

15. A controlled method of raising a form, comprising the steps of:

providing a plurality of jacks connected to a form structure;

supporting the weight of the form structure by attaching said jacks to a wall;

lifting said form structure with said plurality of jacks attached to said wall;

monitoring a lift position of said jack with a lift position sensor corresponding to each said jack; and pausing one or more jacks during times when one or more lift position sensors corresponding to said one or more jacks reports a position value that is outside of a deviation tolerance range.

16. The method according to claim 15, wherein the step of monitoring comprises the steps of:

transmitting a jack lift position value to a control unit;

storing said jack lift position value in the control unit;

computing a deviation by comparing said jack lift position value to the jack lift position values corresponding to other jacks;

comparing the deviation to said deviation tolerance range.

17. The method according to claim 15, further comprising the step of stopping the jack when the sensor corresponding to said jack reports a position value equal to a predefined final lift height value.

18. The method according to claim 15, wherein the pausing step comprises the step of:

when a sensor corresponding to one jack reports a position value that is outside of said deviation tolerance range and below the position values of other jacks having corresponding sensors reporting position values that are inside of said deviation tolerance range, pausing other jacks.

19. The method according to claim 15, wherein the pausing step comprises the step of:

when a sensor corresponding to one jack reports a position value that is outside of said deviation tolerance range and above the position values of other jacks having corresponding sensors reporting position values that are inside of said deviation tolerance range, pausing said one jack.

20. The method according to claim 15, further comprising the steps of:

stopping each said jack when the corresponding sensor reports a position value equal to a predefined final lift height value; and anchoring a plurality of form panels to said formed object, said form panels being attached to said form structure.

* * * * *